US009155390B2

(12) United States Patent
Ferguson et al.

(10) Patent No.: US 9,155,390 B2
(45) Date of Patent: Oct. 13, 2015

(54) PRESENTATION VIEWING APPARATUS AND METHOD

(71) Applicant: Simex Inc., Toronto (CA)

(72) Inventors: Brian Ferguson, Pickering (CA); Sal Agosta, Stouffville (CA); Alex Gil, Toronto (CA)

(73) Assignee: SIMEX INC., Toronto, Ontario (CA)

( * ) Notice: Subject to any disclaimer, the term of this patent is extended or adjusted under 35 U.S.C. 154(b) by 101 days.

(21) Appl. No.: 13/840,874

(22) Filed: Mar. 15, 2013

(65) Prior Publication Data

US 2014/0259967 A1 Sep. 18, 2014

(51) Int. Cl.

| | |
|---|---|
| ***A63G 31/16*** | (2006.01) |
| ***A47C 1/121*** | (2006.01) |
| ***E04H 3/22*** | (2006.01) |
| *A63J 1/00* | (2006.01) |

(52) U.S. Cl.
CPC . *A47C 1/121* (2013.01); *E04H 3/22* (2013.01)

(58) Field of Classification Search
CPC ..... A63G 1/00; A63G 1/10; A63G 1/30; A63G 21/00; A63G 21/08; A63G 31/00; A63G 31/02; A63G 31/16; A63J 1/00; A63J 3/00; A63J 25/00; G09B 9/00; G09B 9/02; G09B 9/04; G09B 9/06; G09B 9/14; G09B 9/32
USPC ..... 472/39, 44–47, 59–61, 130–131; 434/29, 33, 34, 35, 55
See application file for complete search history.

(56) References Cited

U.S. PATENT DOCUMENTS

| | | | | |
|---|---|---|---|---|
| 3,469,837 | A | 9/1969 | Heilig | |
| 3,628,829 | A | 12/1971 | Heilig | |
| 4,014,523 | A | 3/1977 | Reader | |
| 5,192,247 | A | 3/1993 | Barr et al. | |
| 6,354,954 | B1 | 3/2002 | Sumner | |
| 6,431,989 | B1 * | 8/2002 | Katayama et al. | 472/60 |

FOREIGN PATENT DOCUMENTS

| | | | |
|---|---|---|---|
| CN | 102113782 | A | 7/2011 |
| EP | 0433557 | B2 | 2/1999 |
| WO | 2012/039601 | A1 | 3/2012 |

OTHER PUBLICATIONS

International Search Report and Written Opinion received in connection to the corresponding international patent application No. PCT/CA2014/000257.

* cited by examiner

*Primary Examiner* — Kien Nguyen
(74) *Attorney, Agent, or Firm* — Philip C. Mendes da Costa; Bereskin & Parr LLP/S.E.N.C.R.L., s.r.l.

(57) ABSTRACT

A motion simulator is provided with a motion simulator accommodation that is dynamically mounted to a fixed datum or platform and is positioned facing a presentation. The motion simulator is provided with one or more access fitting which may be used to assist a person to enter the motion simulator accommodation. At least one of the motion simulator accommodation and the access fitting is movable with respect to each other from a first position to a second position, wherein, in the second position, the access fitting is less perceptible during the presentation than in said first position.

35 Claims, 8 Drawing Sheets

PRESENTATION VIEWING APPARATUS AND METHOD

FIELD OF INVENTION

This application relates to a presentation viewing apparatus and method. In one embodiment, the application relates to a seat or other accommodation which is dynamically mounted to a non-moveable platform or other fixed datum wherein one or more access members, such as a floor or hand rail, is moveable relative to the accommodation to be less perceptible during a presentation.

BACKGROUND OF THE INVENTION

The following is not an admission that anything discussed below is part of the prior art or part of the common general knowledge of a person skilled in the art.

In the entertainment industry there has been a continuing effort to provide spectators with heightened realism in the entertainment viewing experience. It may be that a spectator may be able to feel immersed in the experience when placed in an unobstructed position, in front of a large field of view.

Presentation venues that provide large screens, and that provide motion simulation are known. However, multi-axis motion simulators may tend to be either relatively small, or relatively expensive, or both. For example, published application WO/2012/039601 discloses a passenger carrier that utilizes a platform that is provided with a plurality of seats. The carrier is mounted on a lift arm, which may be used to move the platform with the seats to a desired viewing position.

SUMMARY OF INVENTION

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

According to one broad aspect, one or more seats or other accommodation is dynamically mounted to a fixed platform. The dynamical mount enables a passenger in the seat to experience one or more of yaw, pitch, roll, vertical translation, forward translation and sideways translation during a presentation. Typically, the extent of movement of the seat from a neutral position may be about 2 feet or less. For example, the seat may move in any direction from 1-24 inches, 3-20 inches, 4-15 inches. Suitable combinations of a small degree of movement a particular direction, in combination with a suitable image projected upon a screen may provide a sensation of motion in a user that matches the image that is projected. Accordingly, a passenger may feel as if they are travelling in a plane or on a roller coaster.

In order to permit a person to enter the seat, a walkway may be provided. When seated in the chair, a passenger's feet may touch the walkway. Therefore, throughout the presentation, the user may have a sensation of firm ground under their feet. If the presentation is, e.g., to simulate flight, then the sensation of the walkway under the passenger's feet may detract from the experience.

Alternately, a hand rail may be provided to assist a person to enter a seat, or merely as a safety bar that is at the edge of a platform on which the seat is provided. During the presentation, the handrail or safety bar may be visible to the passenger. For example, the handrail may be positioned centrally in the passenger's central line of site to the presentation. As such, the handrail is a reminder that a person is safely seated in a theatre and this may detract from the experience.

In accordance with this aspect, the theatre may be constructed such that a sensory distraction member, such as a walkway or a handrail, is less perceptible, and preferably is not perceptible, during the performance. The sensory distraction member may be any member that is perceptible by any sense of a user during a performance and may be perceived by a passenger's vision or tactile sense.

It will be appreciated that the sensory distraction member may be moveably mounted between a first position, e.g., a loading position, in which the sensory distraction member is positioned so as to be useable to allow a person to enter or exit a seat, and a second position, e.g., a presentation position, in which the sensory distraction member is moved to a position in which it is less perceptible and, preferable, is essentially not perceptible during the presentation. In another embodiment, the accommodation may be moveable so as to position the passenger further from the sensory distraction member. Alternately, each of the sensory distraction member and the accommodation may be moveable.

The fixed datum may be a platform in a theatre or other presentation center. For example, the fixed datum may be a concrete platform on which a seat is dynamically mounted. An advantage of this design is that a motion simulation experience of enhanced quality may be provided without the need for complicated and expensive equipment such as is used in WO/2012/039601. In addition, the system may be prone to less down time as multiple smaller actuators and drive members may be used, which will be subjected to a smaller load.

In accordance with this aspect there is provided a loge for mounting to a fixed datum in a placement facing a presentation, said loge comprising:

(a) at least a first accommodation dynamically mounted to the fixed datum;

(b) at least a first access fitting mounted adjacent to said accommodation; and, (c) at least one of said accommodation and said first access fitting being movable with respect to each other from a first position to a second position;

in said first position said access fitting is positioned adjacent to said accommodation; and in said second position said access fitting is less perceptible during the presentation than in said first position.

In some embodiments, said first access fitting may be movable from a first position to a second position.

In some embodiments, said first access fitting may be movable mounted with respect to said fixed datum.

In some embodiments, said first accommodation may include a seat for occupation by a spectator during the presentation.

In some embodiments, the loge may further comprise an actively driven multi-degree-of-freedom suspension by which said accommodation is mounted to said fixed datum.

In some embodiments, said suspension is drivable in at least three of (a) yaw, (b) pitch; (c) roll; (d) vertical translation; (e) forward translation; (f) sideways translation.

In some embodiments, the loge may further comprise a programmable controller operably connected to drive said accommodation in said multiple degrees of freedom in conjunction with the presentation.

In some embodiments, said accommodation may have a central sight line towards the presentation, and in said second position said first access fitting may be positioned further away from said central sight line than in said first position.

In some embodiments, wherein said first access fitting comprises a handrail and or a walkway. Accordingly, the loge may further comprise a second access fitting.

In some embodiments, said first access fitting may comprise a handrail; said second access fitting may comprise a pathway; and, in said second position, both said handrail and said pathway are moved to retracted positions.

In some embodiments, the loge may further comprise an accommodation restraint operable between a secured position in which a spectator is secured in the accommodation and an access position in which the spectator may enter the accommodation.

In some embodiments, the first access fitting may not be moveable to the second position until the accommodation restraint is in the secured position.

In accordance with this aspect there is also provided a motion simulator accommodation comprising:

(a) a fixed datum;

(b) a dynamic multi-degree-of-freedom active suspension mounted to said fixed datum;

(c) a loge mounted to said suspension, said loge having a central sight line toward a presentation zone;

(e) a gangway leading to said loge, said gangway including a first sensory distraction member; and at least one of said loge and said first sensory distraction member being movable from a first position to a second position;

in said second position said first sensory distraction member being less distractive than in said first position.

In some embodiments, said first sensory distraction member may be movable from a first position to a second position.

In some embodiments, said first sensory distraction member may be movable mounted with respect to said fixed datum.

In some embodiments, at least a portion of said gangway may be movable mounted with respect to said fixed datum.

In some embodiments, said loge may include a seat for occupation by a spectator during a presentation and a restraint member.

In some embodiments, said loge may have a central sight line towards the presentation, and in said second position said first access fitting may be positioned further away from said central sight line than in said first position.

In some embodiments, said first sensory distraction member may comprise a handrail.

In some embodiments, said first sensory distraction member may comprise the gangway.

In some embodiments, said first sensory distraction member may comprise a handrail and the gangway; and, in said second position, both said handrail and said gangway may be moved to retracted positions.

In some embodiments, the motion simulator accommodation may further comprise an accommodation restraint operable between a secured position in which a spectator is secured in the loge and an access position in which the spectator may enter the loge.

In some embodiments, said first sensory distraction member may be movable from a first position to a second position and the first sensory distraction member may not be moveable to the second position until the accommodation restraint is in the secured position.

In accordance with this aspect there is also provided a motion simulator accommodation comprising:

(a) a loge connected to a fixed datum by an actively driven multi-degree-of-freedom suspension;

(b) said loge having a central sight line toward a presentation zone; and, (c) a gangway by which to gain entry to said loge, said gangway including a first sensory distraction member; and, when said gangway is not in use, said first sensory distraction member being movable away from said central sight line.

In some embodiments, said first sensory distraction member may be movable from a first position to a second position; in said first position said first sensory distraction member being in a position of sensation; in said second position said first sensory distraction member being away from the position of sensation.

In some embodiments, said loge may include a seat for occupation by a spectator during a presentation and a restraint member.

In some embodiments, said first sensory distraction member may comprise a handrail.

In some embodiments, said first sensory distraction member may comprise said gangway.

In some embodiments, said first sensory distraction member may comprise a handrail and said gangway, both of which may be movable away from said central sight line.

In some embodiments, the motion simulator accommodation may further comprise a restraint operable between a secured position in which a spectator is secured in the loge and an access position in which the spectator may enter the loge, said first sensory distraction member may be movable from a first position to a second position and the first sensory distraction member may not be moveable to the second position until the accommodation restraint is in the secured position.

In accordance with this aspect there is also a gangway for a motion simulator accommodation, the motion simulator accommodation being positioned to face toward a presentation and having a central line of sight relative to the presentation, wherein said gangway comprises a first sensory distraction member movable between a first position and a second position; in said first position said first sensory distraction member being in a position of sensation; in said second position said first sensory distraction member being away from said position of sensation.

In some embodiments, said motion simulator accommodation may include a seat for occupation by a spectator during a presentation and a restraint member.

In some embodiments, said first sensory distraction member may comprise a handrail.

In some embodiments, said first sensory distraction member may comprise said gangway.

In some embodiments, said first sensory distraction member may comprise a handrail and said gangway, both of which are movable away from said central sight line.

In some embodiments, the motion simulator accommodation may further comprise a restraint operable between a secured position in which a spectator is secured in the motion simulator accommodation and an access position in which the spectator may enter the motion simulator accommodation, said first sensory distraction member may be movable from a first position to a second position and the first sensory distraction member may not be moveable to the second position until the accommodation restraint is in the secured position.

It will be appreciated by a person skilled in the art that a loge or accommodation may embody any one or more of the features contained herein and that the features may be used in any particular combination or sub-combination.

BRIEF DESCRIPTION OF THE ILLUSTRATIONS

The drawings included herewith are for illustrating various examples of articles, methods, and apparatuses of the teaching of the present specification and are not intended to limit the scope of what is taught in any way.

The foregoing aspects and features of the invention may be explained and understood with the aid of the accompanying illustrations, in which:

FIG. 1*a* is a general arrangement perspective view of a presentation apparatus according to an aspect or feature of the invention at a time when a presentation is not underway;

FIG. 1*b* is a general arrangement perspective view of the presentation apparatus of FIG. 1*a* during a presentation;

Figure 5:
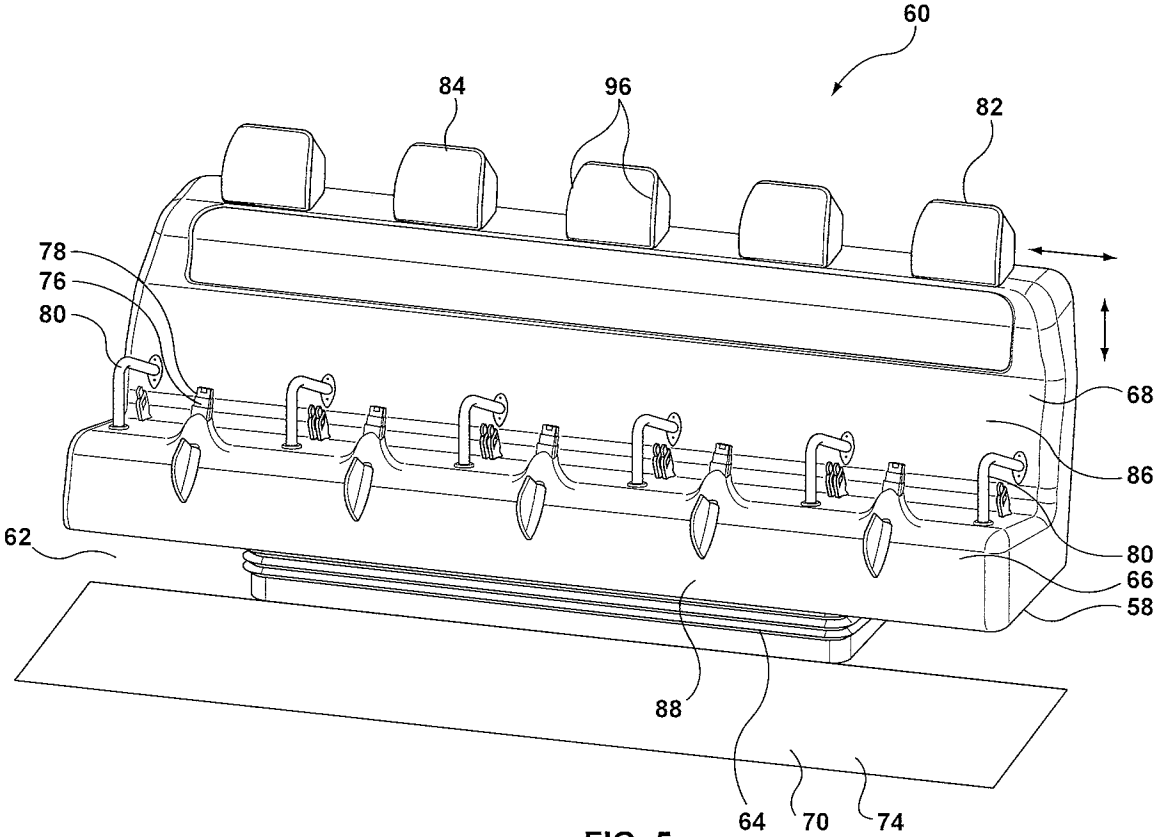
FIG. 5 is a perspective view from in front, to the left and slightly upwards of the apparatus of FIG. 1.
Figure 6A:
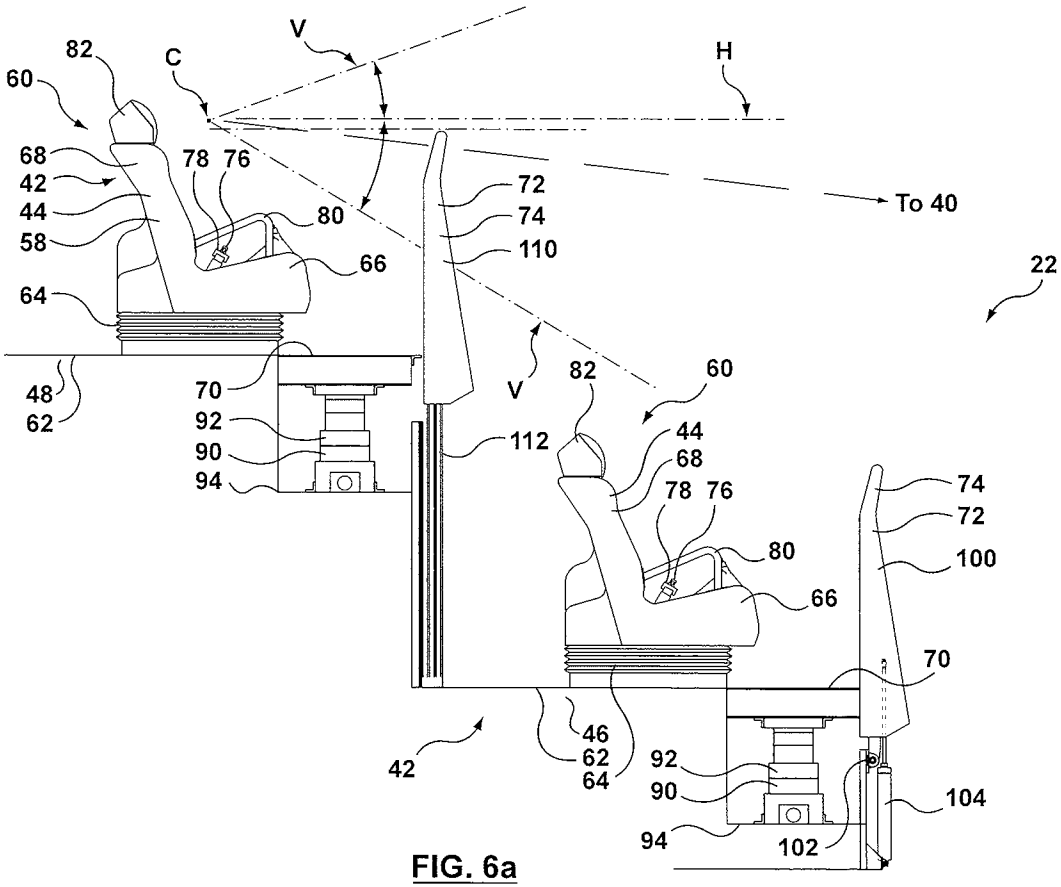
Figure 6B:
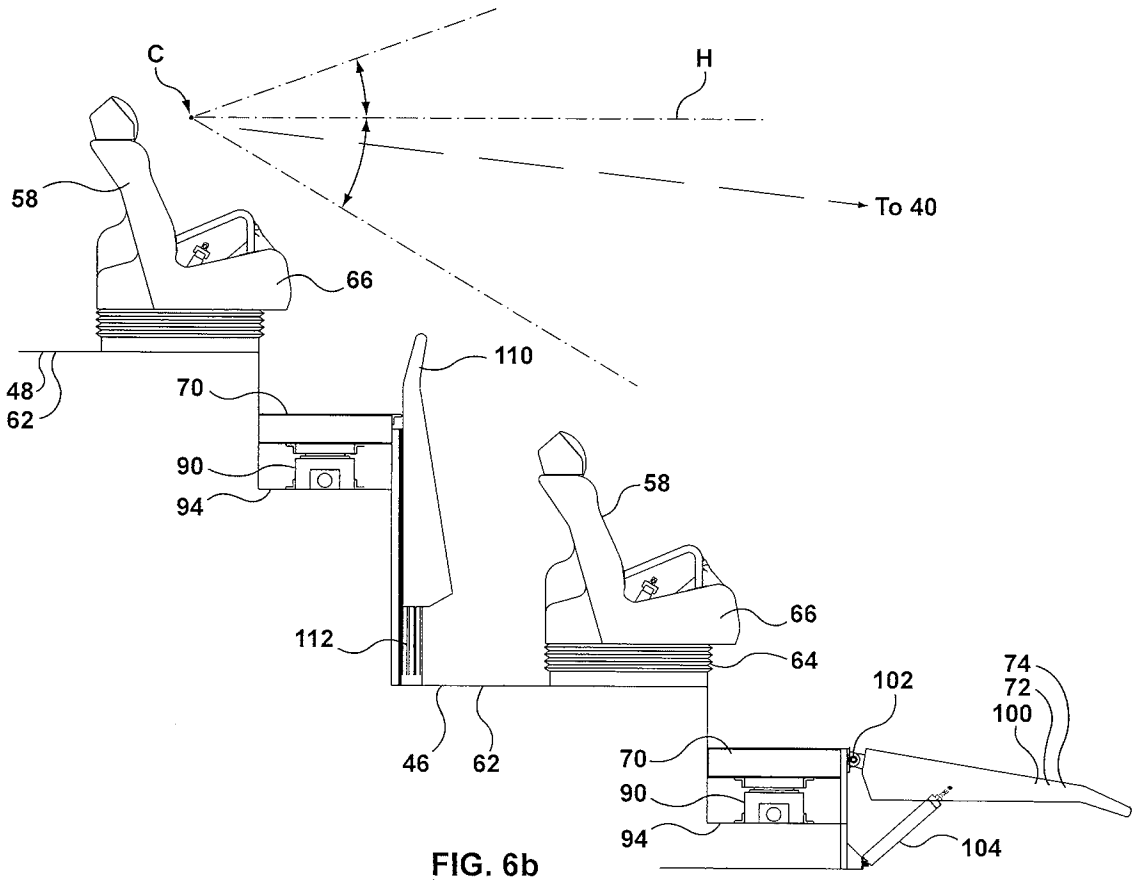

FIG. 6*a* shows a side view of the apparatus of FIG. 5 at a time of entry of patrons to the venue; and, FIG. 6*b* shows the apparatus of FIG. 6*a* at a time during the presentation.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

In the description, like parts are marked throughout the specification and the drawings with the same respective reference numerals. The drawings may be taken as being to scale, or generally proportionate, unless indicated otherwise.

The scope of the invention herein is defined by the claims. Though the claims are supported by the description, they are not limited to any particular example or embodiment, and any claim may encompass processes or apparatuses other than the specific examples described below. Other than as indicated in the claims themselves, the claims are not limited to apparatuses or processes having all of the features of any one apparatus or process described below, or to features common to multiple or all of the apparatus described below. It is possible that an apparatus or process described below is not an embodiment of any claimed inventions.

The terminology used in this specification is thought to be consistent with the customary and ordinary meanings of those terms as they would be understood by a person of ordinary skill in the art in North America. Following from the decision of the Court of Appeal for the Federal Circuit in *Phillips* v. *AWH Corp.*, the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of experience in the art.

By way of general overview, an entertainment venue is indicated generally as 20. Entertainment venue 20 may be termed a theatre, and auditorium, an arena, concert hall, an opera, and so on. It includes an area for patrons or spectators indicated generally as 22, and a zone of presentation, indicated generally as 24. The zone of presentation may include a stage 26 and a screen 28, or both.

A projection system 30 may be mounted in a position to cause the material of the presentation to be seen on the stage or screen, as may be. The screen or stage may be presented generally in front of the area for patrons or spectators, but may in some instances have depth and may "wrap around" the viewers to some extent. It may be that the presentation has depth of field, in the sense of being a 3-D presentation, or a holographic presentation. The presentation may have a total area of projection bounded by left, right, top and bottom margins. At or near the centroid of that area of projection is a point that may be defined as the center of display 40. For the purpose of this discussion, the center of display may be taken as the centroid of the area of projection. The size of entertainment venue 20 may range greatly, seating perhaps as many as 500 persons. In one embodiment it may seat about 180-200 persons.

The area for patrons or spectators may include a range of viewer accommodations 42, generally defining individual seating 44 for each spectator. The seating may be arranged in tiers at a variety of vertical positions, taking the level of the stage, or the lowest margin of the display screen as a baseline datum. Several tiers are indicated as 46, 48, 50, 52. The various tiers are accessible by means of access ramps or stairways indicated generally as 56.

It may be noted that the tiers are staggered vertically and horizontally. Seating 44 may be arranged along a curved arc, with a focus or center of curvature that is in the plane of the screen or somewhat behind the plane (or possibly continuously curved surface) of screen 28. The tiers themselves are defined by the fixed physical structure of entertainment venue 20, and may generally be fixed in position relative to stage 26 or screen 28, as may be. The vertical and horizontal staggering may be intended to give every view the impression of having a "front row seat", that is to say, a substantially unobstructed view of zone of presentation 24, or at least the center and large majority thereof. In this description, each spectator will be understood to have a field of view when facing forward in their allotted seat. The center, or focus of that field of view may be taken as the center of projection 40. It is assumed that in the presentation the center of attention may move about the screen or stage, but will, most often be at or close to the center of projection. A spherical coordinate system can be defined in which an axis having an origin C at the viewer's eye (presumed looking forward) to center of projection 40. Given the curvature of the viewing area, the front of the seat will be perpendicular to this central axis, and the origin of the axis may be taken as being the average body height above seat level, typically a distance of 27-30 inches for an adult. The view of the presentation may vary with the distance up or down, left or right, of the center of the arc and center of the tiers of seating. The field of view of the center seat may have an unobstructed view of 90% or more of the presentation area of projection. The seats at the extremities of zone of presentation 24 may view their nearest margin fully, but only 80% of the way to the farthest margin. The normal field of view, V, shown in FIG. 6*a* has an arc of notionally about 50 degrees in the vertical direction, being perhaps 25 degrees above and below the central axis from origin C. In FIGS. 6*a* and 6*b* a horizontal datum H, is also shown. In the example the vertical zone of view goes from about 20 degrees above H to about 30 degrees below H, however the angular portions above and below horizontal may vary according to the tier of seating of the observer. Although only one construction of a field of V is shown in FIGS. 6*a* and 6*b*, there is a corresponding field of view for each seat in the array of seating of venue 20.

For the purposes of discussion it is assumed that each accommodation 42 is a chair or seat, be it singular or in a gang, i.e., a bench. This need not necessarily be so. The accommodation could be a standing, leaning, reclined, partially reclined or other position. For generality, accommodation 42 may be any of these things. Typically, it may be a seat. Several seats may be grouped together in a bench 58. Several in this context may mean as few as two or as many as perhaps eight or ten. In the embodiment shown, the grouping of seats may number 5 or 6. In this discussion the term "loge", 60, may be used as representing a seating area or lodgement of a group of seats, such as those of bench 58.

Bench 58 (and therefore each accommodation or seat of bench 58 in loge 60) may be mounted on the fixed structure of its respective tier (be it 46, 48, 50, 52, 54, etc.). That fixed structure may be a steel truss or framework, but may also more commonly be the poured reinforced concrete of the stadium or theatre more generally. In respect of each loge 60, its respective tier defines a fixed structural datum. In this discussion, that local datum shall be referred to as the datum of floor 62. Floor 62 is the immediate, local, floor, or base structure, to which bench 58 is mounted. It may be a flat, poured concrete floor, or it may have the form of a shelf or pedestal or tier. Whatever form it may have, the floor mounting is located beneath each bench 58, or each bench 58 is cantilevered from (e.g., by a mounting bracket or other mounting fitting), its floor mounting, and that floor mounting defines a stationary datum. That stationary datum is at a level adjacent to the seat. The floor may typically be at the level of walking for entry or egress into bench 58. It may be as high as the bottom of seat rest portion 66 of bench 58, and may underlie seat rest portion 66. Alternatively it may be as high as the upper portions of back rest portion 68 of bench 58, and bench 58 may be mounted forwardly of floor 62 in a cantilevered mount toward screen 28. It is the position of floor 62 that determines the nominal "floor height" of the walkways relative to seat rest portion 66 for normal ingress and egress from the seats of bench 58.

A suspension system, or simply a suspension, is indicated generically as 64. Each bench 58 is mounted to the structural datum defined by its floor 62 (or floor mounting, however it may be called) by a suspension 64. Suspension 64 provides a dynamic connection between bench 58 and its supporting pedestal or floor 62, namely the degrees of freedom of motion of bench 58 relative to that structural datum. Those degrees of freedom may include vertical displacement (sometimes referred to as "heave"), lateral or sideways displacement relative to the screen; pitch (meaning roll about the lateral horizontal axis of the seat such that the occupant feels as if they are being leaned forward or backward; roll about the x-axis, so that the occupant feels as if they are being tipped left or right; and displacement along the x-axis in the forward or rearward direction such as may permit the simulation of acceleration or deceleration toward or away from screen 28. Each bench may also vibrate or have other dynamic or sensory features.

In contrast to more complicated motion simulators such as flight simulators, the range of motion, or excursion, of suspension 64 is local rather than global, and is limited to motion of bench 58, as opposed to motion of the underlying tier. That is, suspension 64 is a seating-connected suspension system, as opposed to a motion-base system in which several sets of seats are connected to a common floor, and the floor is driven by a set of large hydraulic or pneumatic actuators in, for example, a flight simulator. In this apparatus, the immediate seat-floor is stationary. That is, while there may be many tiers in entertainment venue 20, those tiers are fixed in position and provide a common reference datum to all seating. Each loge of seating, however, has its own independent local suspension 64 mounted to that structural datum. The range of excursion of a "local" suspension is modest, typically being of the order of magnitude of the size of the bottom portion of the seat itself (perhaps up to 10 inches in heave, 2-3 inches in x-direction or y-direction displacement, and so on), as compared to 3 feet or substantially much more in multi-axis full-motion simulators. In the apparatus of FIG. 1, it may be that no excursion exceeds 18 inches.

Access to each loge is by a gangway or aisle, or pathway or catwalk, or access way, or floor identified generically as gangway 70. Adjacent to gangway 70, and between gangway 70 and zone of presentation 24 may be a series of handrails or guardrails, 72. Gangway and guardrails 72 define safety fittings, or access fittings 74.

When a spectator arrives, he or she uses gangway 70 and handrails 72 to reach the allotted seat. Upon sitting down, or, more generically, upon arriving at the individual accommodation, the person sits down and is secured in place by a securement, or retention fitting or fittings 76, such as a lap belt 78. Other kinds of restraints may also be used, such as a gate or retaining bar or holder. An arm rest or grip 80 may also be provided. Bench 58 may include other features such as a head-rest 82, which may include a vent 84 for blowing air on the patron's neck, speakers 96 providing stereo sound, a vibrating seat back portion 86, and a leg-tickler 88. Each seat of bench 58 may have a weight sensor or other sensor operable to detect the presence of a person in that accommodation. That sensor is linked electronically with a securement sensor that determines whether fitting 76 is closed and locked. Unless a securement is closed and locked at each location at which a person is sensed in the accommodation, the show is inhibited from starting, and, consequently, access fittings are inhibited from moving from their initial seat access ingress and egress position.

In the first condition or position, shown in FIG. 6*a*, which may be termed the access or entrance-and-exit, active or deployed, condition or position, fittings 74 are perceptible to the spectator, and, in the case of railings 72, may be in a position obstructing, or partially obstructing vision of zone of presentation 24. This is represented by railings 72 falling within the sight lines of field of vision V in FIG. 6*a*. Gangway 70 is movable. Apparatus 20 includes a mechanical transmission 90 that is connected to gangway 70 and, on receipt of control instructions as from a programmed controller, mechanical transmission 90 may extend or retract gangway 70 as required. In the embodiment shown, gangway 70 is supported on vertically telescoping cylinders 92, which may be pneumatic or hydraulic, located in a machinery well 94 and which may lock in their raised or extended, deployed, or default position as when people may walk upon gangway 70. In the lowered, retracted, or activated position, gangway 70 is withdrawn such that the spectators' feet may dangle. A scissors lift or jack arrangement could also be used. Alternatively gangway 70 could be hinged along one edge, and could be moved by a pivoting arrangement between deployed and retracted positions. In the embodiment shown, in the deployed position gangway 70 is flush with floor 62. In the retracted position gangway 70 is shy of, i.e., sunken with respect to the level of floor 62.

Figure 1A:
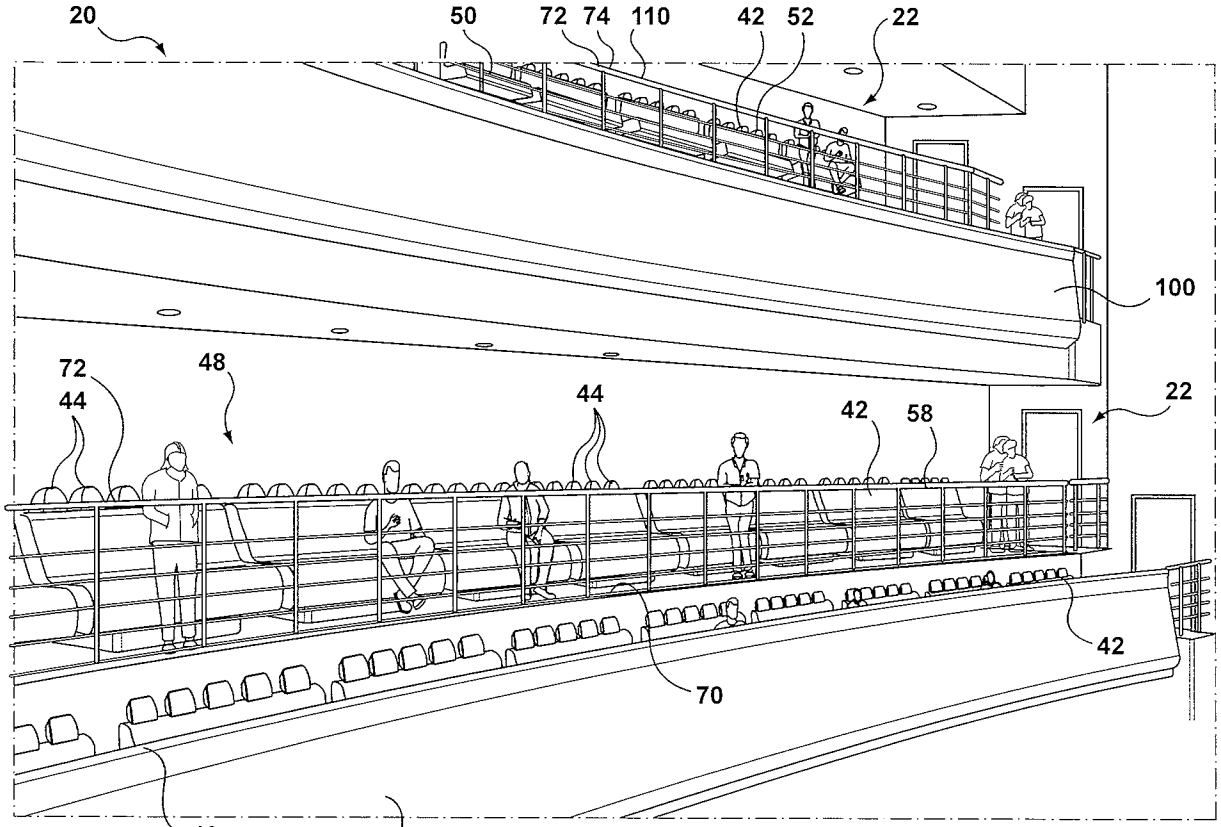
Figure 1B:
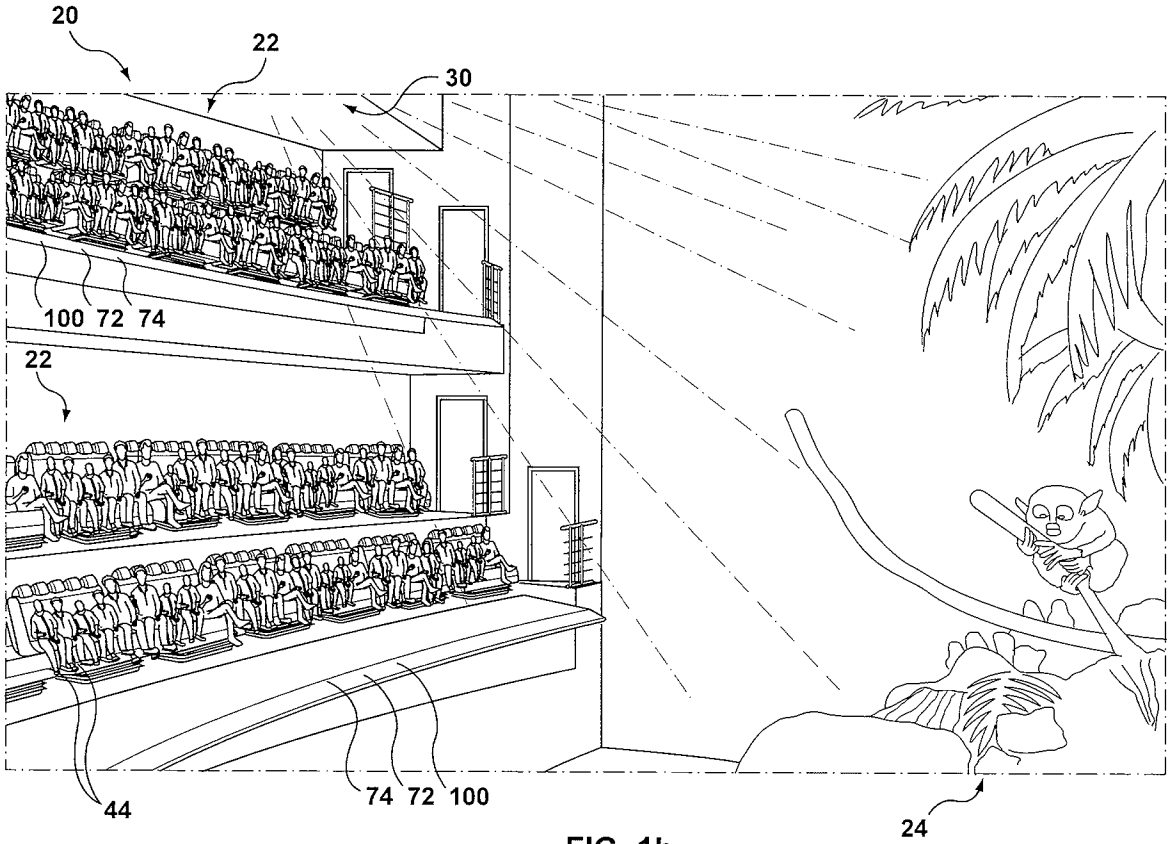
Figure 2:
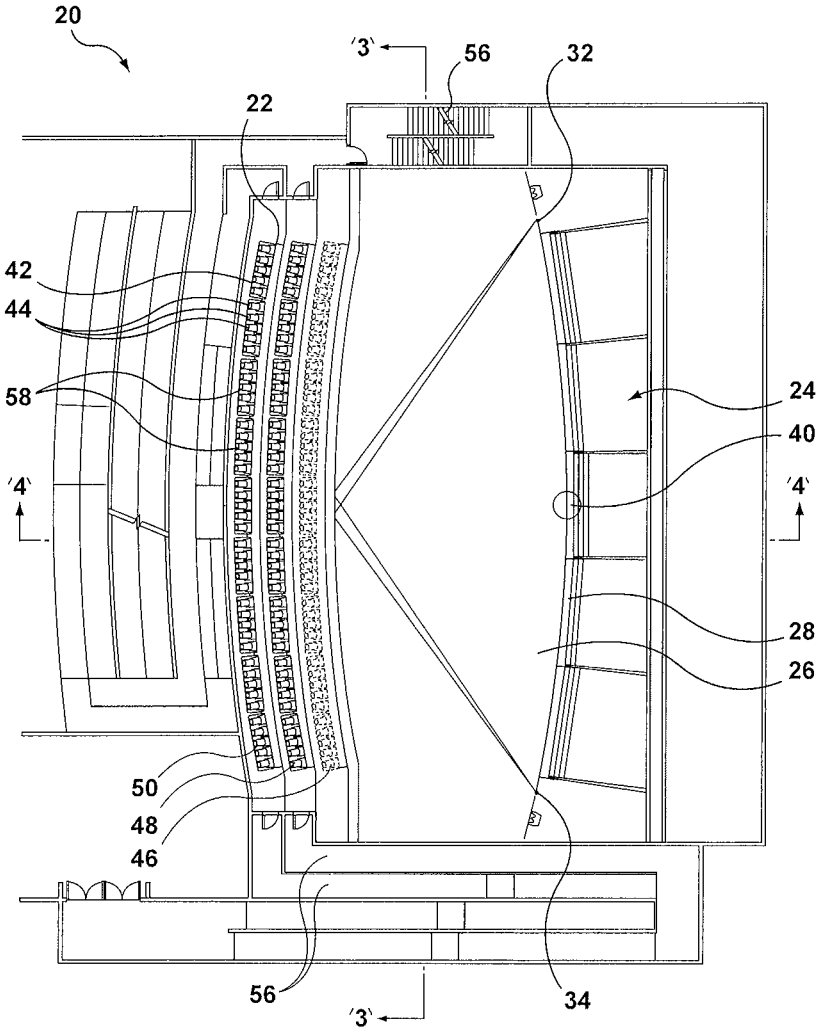
FIG. 2 is a top view of an entertainment venue such as may employ the apparatus of FIG. 1.
Figure 3:
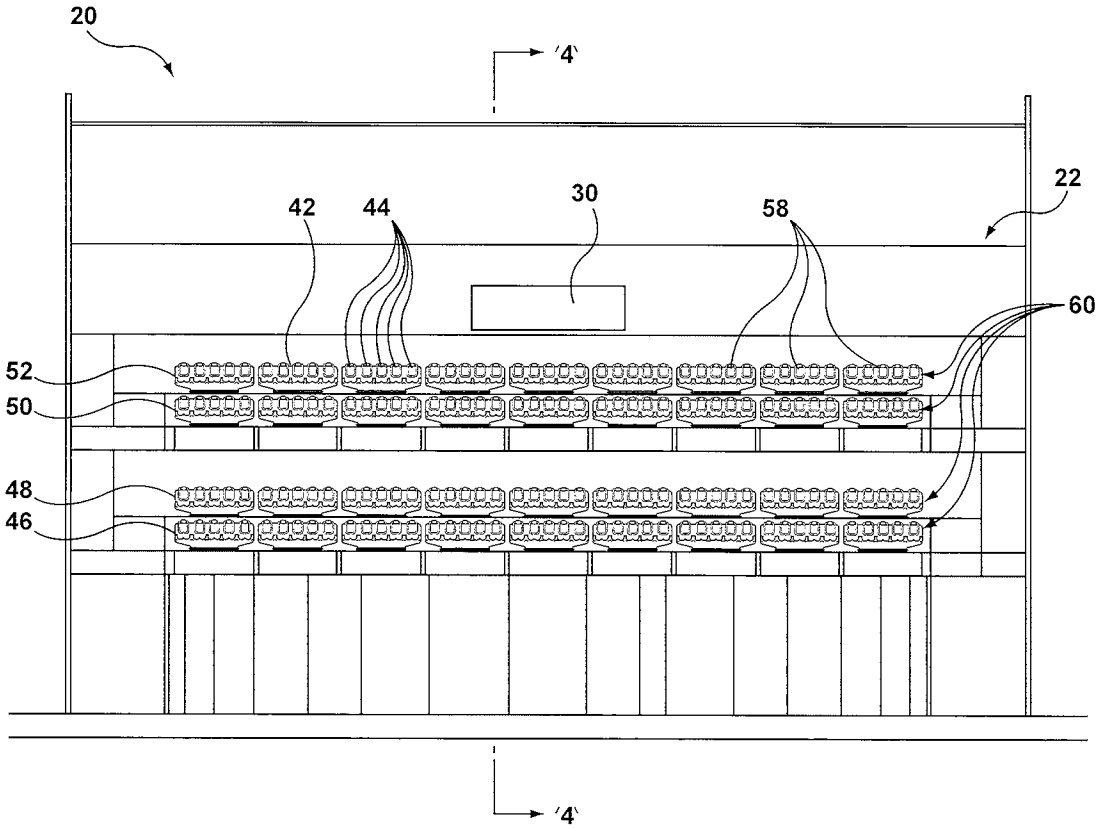
FIG. 3 is a front view looking toward the seating of entertainment venue of FIG. 2 taken on arrows '3-3'.
Figure 4:
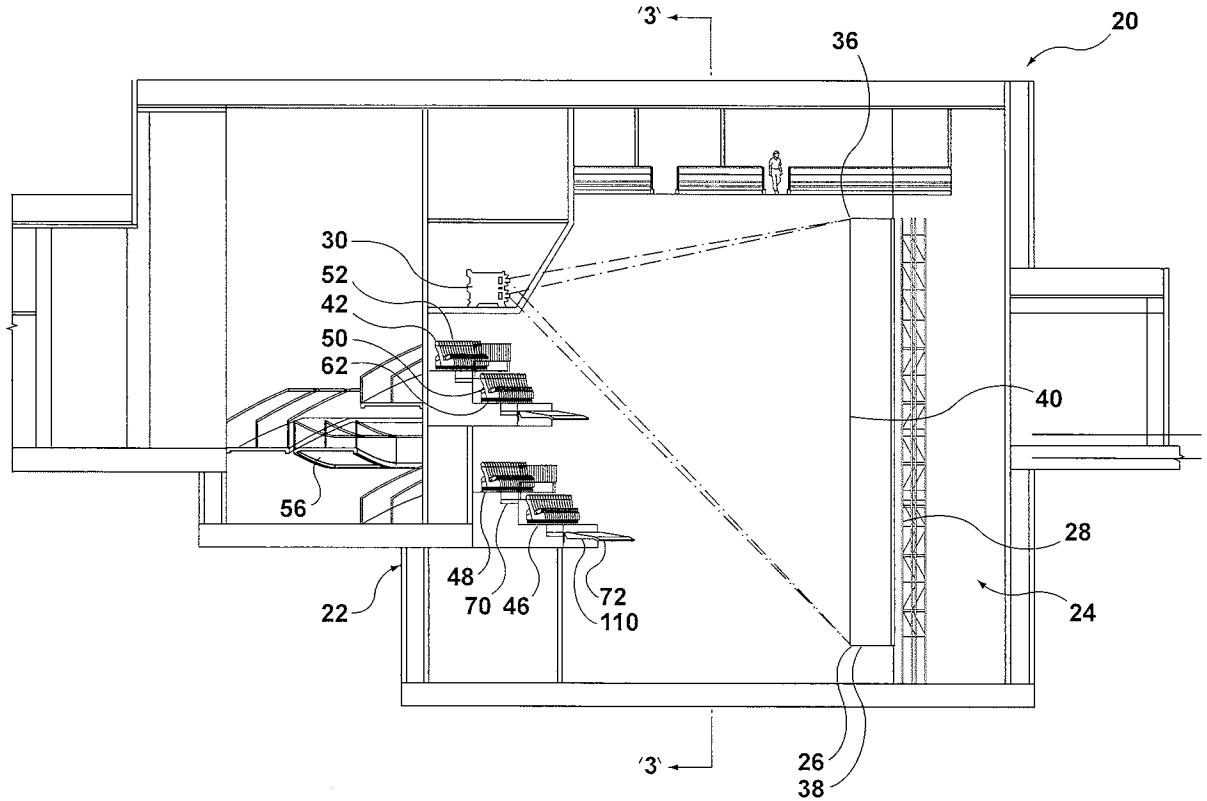
FIG. 4 is a side-cross-sectional view of the entertainment venue of FIG. 2 taken on section '4-4'.

Similarly, the handrails or railings 72 are movable mounted such as to permit motion from a first or deployed position as in FIGS. 1*a* and 6*a*, to a second or retracted position as in FIGS. 1*b* and 6*b*. In the instance of the lower, foremost tier in FIGS. 6*a* and 6*b*, lower railing 100 is pivotally mounted at its base, at 102, such that operation of a pneumatic cylinder 104 causes it to pivot to the raised position of FIG. 6*a*, and the forwardly pivoted lowered position of FIG. 6*b*. In the lowered position of FIG. 6*b* it is less visually distractive (i.e., further from the central axis of the zone of view) than in the raised position of FIG. 6*a*. In the instance of the upper, rearward tier of FIGS. 6*a* and 6*b*, hand railing 110 is mounted on vertically axially oriented guides or rails or track ways, generally identified as 112 which, however called, stand upwardly of floor 62 of the lower, foremost bench 58. Whether driven by pneumatic or hydraulic cylinders; chains; gears; cables; or other means, railing 110 is driven between a first, upper, deployed or default position, as in FIGS. 1*a* and 6*a*; and a second, activated, retracted, withdrawn, lowered, or out-of-the-way position as shown in FIGS. 1*b* and 6*b*. In either case, railing 110 is in a less easily perceived, less obstructive position when dropped down, and is further from the center of the field of view. Railings 100 and 110 may be normally locked in the raised position, and only unlocked and lower by an active signal. Their default position in case of power outage or any other condition is the raised position. All railings could be like railing 100, or like railing 110. A pivoting railing may be used for the lowermost railing in the array of loges 60 in venue 20.

The floor and handrail motion has been described above. Additional in-theatre effects may be triggered by 24 V dc signals from the projection control studio, typically from a computer controlled presentation program. For example, there may be an overhead water drop. Venue 20 may have air moving apparatus, such as fans or forced air ventilation to simulate wind blowing through the theatre. A fog system may be located at the front of the theatre. A snow system may also be located to cause snowflakes to fall in front of the presentation. There may be strobe lights or other lighting effect systems. There may be a "wall wash" of side lighting projected on the side walls of venue 20 to enhance an on-screen or on-stage visual presentation. To the extent that the special effects may require compressed air (e.g., an air compressor, a pressure regulator, and a conditioning system, air may be directed to suitable solenoid valves controlled by a Show and Effects controller at the projection control office or studio. A distribution manifold carries air to the various seats and rails. All water and air systems are piped in a loop system to maintain roughly equalized pressures throughout the system. To the extent that water may be used for effects, all water is filtered and softened, and is supplied through a pipe manifold similar to the air supply.

Once all of the guests are seated and secured by safety restraints in their seats, a new show can be started. This signal triggers a "Show Start" sequence that initiates the fading of background music, the dimming of the house lights, a switching to a "Show Audio" mode and the start of the "Show Media", the audio and visual portions of the program being co-ordinated. Initiation of the "Show Media" portion causes the projector douser to open, permitting projection. Once this has happened, an "Effects Sequence" may begin. The "Effects Sequence" includes, as initial actions, the dropping of the floor from under the spectators' legs, and the dropping or retraction of the handrails and such other visual distractions as may be to the positions shown in FIGS. 1*b* and 6*b*. The dropping of the floor, for example, may not be a retraction of a visual obstruction or distraction, but it is a removal of a sensory distraction, from a first position in which it is perceptible to the senses, e.g., by the touch of feet on the floor member, to a second position in which it is less perceptible (or not perceptible at all). Similarly, retraction of handrails moves a visual distraction from a position of distraction closest to the central axis of the field of view to a less perceptible (and possible not perceptible at all) position in which they are further from the central axis of the field of view, are less of a distraction, and perhaps no longer a distraction at all.

The dropping of the floor may be appropriate to the images on the screen—e.g., perhaps as co-ordinated to a sensation of taking-off (i.e., alighting from the ground) in flight. Subsequent images may be correlated to special effects actions such as tickling on the neck, tickling on the legs, being squirted by water, and various spectra of vibration of the back of the seat or of the entire assembly of bench 58 on its dynamic suspension 64. Wind systems can be used to simulate the effect or feeling of forward motion sensation (as in flying). Lighting and stroke effects may be used to emphasize or reinforce the sensation provides by the visual presentation.

Such a sequence of presentation and effects may play to the end, at which point gangway 70 and railings or handrails 72 return to their loading and unloading, access ingress-and-egress position, as in FIG. 6*a*. When returned and locked, the spectator restraint fittings 76 can unlock, permitting the viewers to leave. The projection douser is closed, the show audio fades to silence, the house lights are brought back up (i.e., un-dimmed), and the audio source is switched to background music while the spectators depart.

Throughout the presentation restraints 76 as well as the doors to the seating area are locked to ensure the safety of the spectators. Should a restraint failure be detected during a presentation, the presentation will stop and the gangway 70 and handrails 72 will return to the initial position shown in FIGS. 1*a* and 6*a*. Alternatively, an operator may stop the presentation at any time with the same effect and result. All of the safety items are continuously monitored by a programmable logic controller, with the default position of access fitting 74 being that of FIGS. 1*a* and 6*a*.

What has been described above has been intended illustrative and non-limiting and it will be understood by persons skilled in the art that other variances and modifications may be made without departing from the scope of the disclosure as defined in the claims appended hereto. Various embodiments of the invention have been described in detail. Since changes in and or additions to the above-described best mode may be made without departing from the nature, spirit or scope of the invention, the invention is not to be limited to those details. The scope of the claims should not be limited by the preferred embodiments and examples, but should be given the broadest interpretation consistent with the description as a whole.

What is claimed is:

1. A loge for mounting to a fixed datum in a placement facing a presentation, said loge comprising:

(a) at least a first accommodation dynamically mounted to the fixed datum;

(b) at least a first access fitting mounted to the fixed datum adjacent to said accommodation; and, (c) at least a second access fitting mounted to the fixed datum adjacent to said first access fitting;

said first access fitting being movable with respect to said fixed datum from a first position to a second position independently of motion of said first accommodation;

said second access fitting being movable with respect to said fixed datum from a first position to a second position, differently from said first access fitting, and independently of motion of said accommodation;

in said first position of said first access fitting, said first access fitting is positioned adjacent to said accommodation; and in said second position of said first access fitting, said first access fitting is less perceptible than in said first position of said first access fitting, whereby, relative to the presentation, in said second position said first access fitting is less distracting than in said second position whatever the position of the accommodation.

2. The loge of claim 1 wherein said first accommodation includes a seat for occupation by a spectator.

3. The loge of claim 1 comprising an actively driven multi-degree-of-freedom suspension by which said accommodation is mounted to said fixed datum.

4. The loge of claim 3 wherein said suspension is drivable in at least three of (a) yaw, (b) pitch; (c) roll; (d) vertical translation; (e) forward translation; (f) sideways translation.

5. The loge of claim 4 further comprising a programmable controller operably connected to drive said accommodation in said multiple degrees of freedom in conjunction with the presentation.

6. The loge of claim 1 wherein said accommodation has a central sight line towards the presentation, and in said second position said first access fitting is positioned further away from said central sight line than in said first position.

7. The loge of claim 1 wherein:

said first access fitting includes a handrail;

said second access fitting includes a walkway; and said walkway is movable from a first position for boarding said accommodation to a second position in which said walkway is less perceptible from said accommodation.

8. The loge of claim 7 wherein said accommodation has a central sight line towards the presentation, and in said respective second positions said first and second access fittings are positioned further away from said central sight line than in said respective first positions.

9. The loge of claim 1 wherein in said first position of said first access fitting said first access fitting is positioned forwardly of said accommodation, between said accommodation and the presentation, and in said second position of said first access fitting said first access fitting remains forward of said accommodation.

10. The loge of claim 1 wherein:

said first access fitting includes a handrail;

said second access fitting includes a pathway;

in said respective first positions said accommodation is located rearwardly of said first and second access fittings relative to said presentation; and in said respective second positions said handrail and said pathway remain forwardly of said datum and said accommodation relative to the presentation.

11. The loge of claim 1 further comprising an accommodation restraint operable between a secured position in which a spectator is secured in the accommodation and an access position in which the spectator may enter the accommodation.

12. The loge of claim 11 wherein the first access fitting is not moveable to the second position until the accommodation restraint is in the secured position.

13. A motion simulator accommodation comprising:

(a) a fixed datum;

(b) a dynamic multi-degree-of-freedom active suspension mounted to said fixed datum;

(c) a loge mounted to said suspension, said loge having a central sight line extending forwardly toward a presentation zone;

(e) a gangway leading to said loge, said gangway including a first sensory distraction member;

said gangway being movably mounted to said fixed datum and extending forwardly of said loge;

said gangway being independently movable relative to said loge; and said first sensory distraction member being movable from a first position to a second position;

in said second position said first sensory distraction member remains forwardly of said loge.

14. The motion simulator accommodation of claim 13 wherein said first sensory distraction member includes a handrail and the gangway; in said second position, both said handrail and said gangway are moved to retraced positions; and said handrail and said gangway are driven independently of each other and independently of said loge.

15. The motion simulator accommodation of claim 13 wherein said loge includes a seat for occupation by a spectator during a presentation and a restraint member.

16. The motion simulator accommodation of claim 13 wherein said loge has a central sight line towards the presentation, and in said second position said first access fitting is positioned further away from said central sight line than in said first position.

17. The motion simulator accommodation of claim 13 wherein said first sensory distraction member comprises a handrail.

18. The motion simulator accommodation of claim 13 wherein said first sensory distraction member comprises the gangway.

19. The motion simulator accommodation of claim 13 wherein said first sensory distraction member comprises a handrail and the gangway; and, in said second position, both said handrail and said gangway are moved to retracted positions.

20. The motion simulator accommodation of claim 13 further comprising an accommodation restraint operable between a secured position in which a spectator is secured in the loge and an access position in which the spectator may enter the loge.

21. The motion simulator accommodation of claim 20 wherein the first sensory distraction member is not moveable to the second position until the accommodation restraint is in the secured position.

22. A motion simulator accommodation comprising:

(a) a loge connected to a fixed datum by an actively driven multi-degree-of-freedom suspension;

(b) said loge having a central sight line toward a presentation zone; and, (c) a gangway by which to gain entry to said loge, said gangway including a pathway upon which to step, and a handrail to grab;

said pathway and said handrail being independently movable from each other, and being independently movable from said loge; at least one of said pathway and said handrail defining a first sensory distraction member; and, when said gangway is not in use, said first sensory distraction member being movable away from said central sight line.

23. The motion simulator accommodation of claim 22 wherein said first sensory distraction member is movable from a first position to a second position; in said first position said first sensory distraction member being in a position of sensation; in said second position said first sensory distraction member being away from the position of sensation.

24. The motion simulator accommodation of claim 22 wherein said loge includes a seat for occupation by a spectator during a presentation and a restraint member.

25. The motion simulator accommodation of claim 22 wherein said first sensory distraction member includes said handrail.

26. The motion simulator accommodation of claim 22 wherein said first sensory distraction member includes said gangway.

27. The motion simulator accommodation of claim 22 wherein said first sensory distraction member comprises both said handrail and said gangway, both of which are movable away from said central sight line.

28. The motion simulator accommodation of claim 22 further comprising an restraint operable between a secured position in which a spectator is secured in the loge and an access position in which the spectator may enter the loge, said first sensory distraction member is movable from a first position to a second position and the first sensory distraction member is not moveable to the second position until the accommodation restraint is in the secured position.

29. A motion simulator accommodation, the motion simulator accommodation being positioned to face forwardly toward a presentation and having a central line of sight relative to the presentation, wherein;

said motion simulator accommodation has a driven suspension by which to impart motion thereto, said driven suspension being a local suspension;

said motion simulator accommodation has an access gangway adjacent thereto, said access gangway having a first sensory distraction member, said first sensory distraction member being movable between a first position and a second position which said accommodation is stationary;

in said first position said first sensory distraction member being in a position of sensation; in said second position said first sensory distraction member being away from said position of sensation.

30. The motion simulator accommodation of claim 29 wherein said motion simulator accommodation includes a seat for occupation by a spectator during a presentation and a restraint member.

31. The motion simulator accommodation of claim 29 wherein said first sensory distraction member comprises a handrail.

32. The motion simulator accommodation of claim 29 wherein said first sensory distraction member is located forwardly of said accommodation in both said first position and said second position.

33. The motion simulator accommodation of claim 29 wherein said first sensory distraction member comprises a handrail of said gangway, both of said gangway and said handrail being movable away from said central sight line.

34. The motion simulator accommodation of claim 29 further comprising an restraint operable between a secured position in which a spectator is secured in the motion simulator accommodation and an access position in which the spectator may enter the motion simulator accommodation, said first sensory distraction member is movable from a first position to a second position and the first sensory distraction member is not moveable to the second position until the accommodation restraint is in the secured position.

35. The motion simulator of claim 29 wherein said local suspension of said motion simulator is limited to a range of motion that does not exceed 18 inches in any degree of freedom.

* * * * *